United States Patent [19]

Ferrari

[11] 3,992,241

[45] Nov. 16, 1976

[54] DYNAMIC RESILIENCY OF TENNIS BALLS

[76] Inventor: Harry Ferrari, 144 W. Swissvale Ave., Pittsburgh, Pa. 15218

[22] Filed: May 22, 1975

[21] Appl. No.: 579,846

[52] U.S. Cl. ..... 156/272; 204/159.14; 204/160.1; 250/492 B; 273/61 C; 250/492 R

[51] Int. Cl.[2] ..... A63B 39/00; B32B 27/16; B01J 1/10

[58] Field of Search ..... 250/492 R, 492 B; 204/158 HE, 159.14, 160.1; 219/121 EB; 273/61 C; 156/272

[56] References Cited

UNITED STATES PATENTS 2,805,072 9/1957 Smith ..... 250/492 B

*Primary Examiner*—Craig E. Church
*Attorney, Agent, or Firm*—Hymen Diamond

[57] ABSTRACT

The dynamic resiliency and the abrasive resistance of tennis balls is improved by uniformly irradiating the balls with about $10^5$ to $10^{10}$ rads of radiation.

4 Claims, 1 Drawing Figure

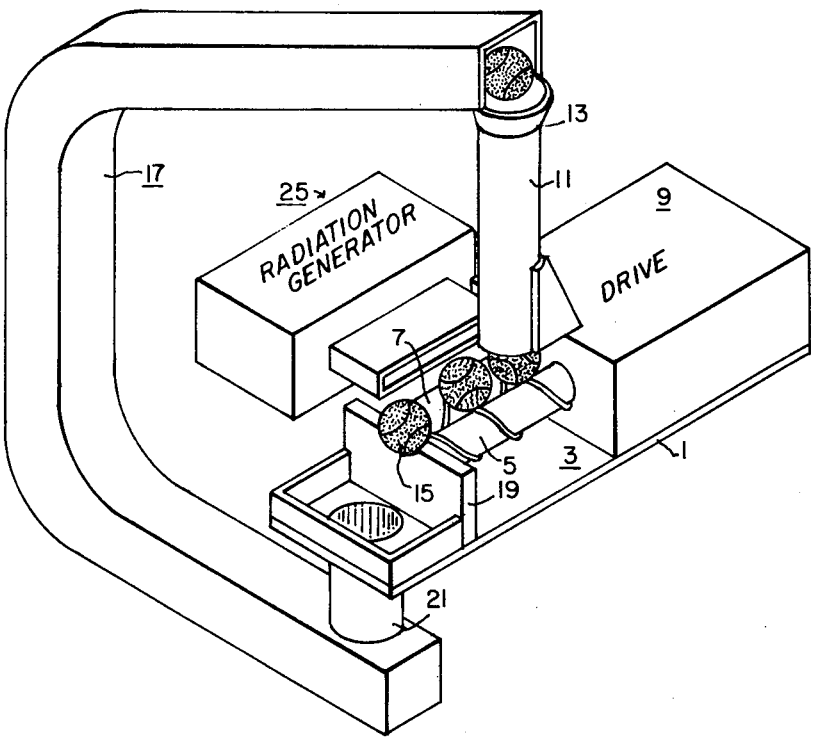
13
17
25
RADIATION GENERATOR
11
9
DRIVE
7
5
3
1
15
19
21

DYNAMIC RESILIENCY OF TENNIS BALLS

REFERENCE TO RELATED DOCUMENTS

1. *Radiation Effects on Organic Material*, Robert O. Bolt and James G. Carroll.

Academic Press 1963 — pages 263 – 265, 7 – 4.5 *Changes in Mechanical Properties* (Elastomeric Materials).

U.S. Pat. No. 2,805,072, Smith

BACKGROUND OF THE INVENTION

This invention relates to sports and has particular relationship to tennis balls. Tennis balls are made of natural or synthetic rubbers or of combinations of natural and one or more synthetic rubbers. A tennis ball has an inner-rubber core which is formed by mating and sealing two hemispherical sections of the rubber together by heating and vulcanization. After the inner-rubber core is formed, an outer cover is adhered to the core. This cover is formed of at least two pieces of felt-covered material having high abrasion resistance which are mated together. The outer cover is typically composed of wool or synthetics such as NYLON or DACRON fabric, or the like.

There are two principle types of tennis balls in use currently: the pressurized type and the unpressurized type. The pressurized type is produced by increasing the pressure within the core to about 14 pounds per square inch guage (about 2 atmospheres) after the core is formed. The pressure within the core of an unpressurized ball is about 1 atmosphere. To improve its characteristics the unpressurized balls have a greater wall thickness of the core, i.e., a greater wall thickness of the resilient elastomeric material. The making of the pressurized ball requires the pressurizing step which is not required in the unpressurized ball. The unpressurized ball demands more elastomeric material. On the whole the pressurized balls are more lively than the unpressurized balls and are preferred; however, they have the disadvantage that they must be packaged in pressurized cans and that the balls lose pressure when removed from the containers and, therefore, become less lively with time. Also, the balls lose pressure if the pressure cans are kept for a long time.

To improve the liveliness of the balls of both types so that they meet demanding standards, tennis balls are often made of natural rubber which is more costly than synthetic rubber.

This invention deals with the liveliness of the balls. Scientifically, the property of elastomers which determines liveliness is called dynamic resiliency. Dynamic resiliency is defined as the ratio of the vertical height of the first rebound of a falling object to the vertical height of the first fall. Damping or hysteresis, which is used to measure deadness, the opposite of liveliness, is proportional to one minus dynamic resilience. It is desirable that the dynamic resilience of tennis balls should be between 0.53 and 0.58.

It is an object of this invention to improve the dynamic resilience of a tennis ball and particularly of an unpressurized tennis ball. It is also an object of this invention to improve the abrasion resistance of the covering of a tennis ball.

SUMMARY OF THE INVENTION

This invention arises from the discovery that the dynamic resilience of a tennis ball is improved substantially by irradiating the ball with about $10^5$ to $10^{10}$ rads. A rad is the quantity of radiation which leads to the absorption of 100 ergs of energy per gram of irradiated material. The radiation may be electrons accelerated by a high electrical field, 100 to 300 KV or higher, as disclosed by Smith patent or protons or neutrons or even x-rays or gamma rays. The main effect of irradiating an elastomer is to ionize the atoms of the material. The ions formed recombine with free electrons to form energetic, unstable molecules. Bond scission result producing free radicals and unsaturation; most of the subsequent overt properties result from these effects. Cross-linking, chain scission, molecular rearrangement and chemical reaction with environmental agents, especially oxidation and ozonization, occur and constitute the preponderant changes. Significant changes in physical properties of elastomeric materials ensue from these processes resulting from irradiation. Irradiation simultaneously induces cross-linking and chain scission in an elastomer. The change in physical properties thus depends upon the dynamic balance between the rates of the two competing processes. Cross linking normally results in an increase in physical properties such as tensile strength, ultimate elongation, and elastic modulus; whereas, scission normally causes a decrease in these properties. It was found that by setting the irradiation at the proper magnitude, that cross linking prevails and an improvement in physical properties is achieved.

Based on the observed phenomenon that irradiation of the proper magnitude and duration can significantly change physical properties of elastomers, it was discovered that irradiation under the proper conditions increases the dynamic resiliency or liveliness of tennis balls. Significant improvements in the dynamic resiliency and dynamic modulus are obtainable with irradiation.

In accordance with this invention, the liveliness of tennis balls is improved by irradiating the balls by about $10^5$ to $10^{10}$ rads. Since the improvement in the properties is the result of the effect of the radiation on the elastomeric inner core, this invention can be practiced by irradiating the inner core of a tennis ball before the cover is adhered. This invention may also be practiced by irradiating the completely covered ball. In this case it was found that a double advantage is achieved. Not only is the liveliness of the ball improved, but the cover also has significantly higher abrasive resistance.

BRIEF DESCRIPTION OF THE DRAWING

For a better understanding of this invention, both as to its organization and as to its method of operation, together with additional objects and advantages thereof, reference is made to the following description taken in connection with the accompanying drawing in which the single FIGURE is a view in perspective, generally diagrammatic, of apparatus for practicing this invention.

DETAILED DESCRIPTION OF INVENTION

The apparatus shown in the drawing includes a support 1 on which there is mounted a roller assembly 3. The assembly 3 includes threaded rollers 5 and 7 which are rotated by a drive 9. On the container of the drive 9 a guide 11 is supported. This guide is connected to a hopper 13. Tennis balls 15 are fed into the hopper 13 by a conveyor 17 and under gravity pass through the guide 11 and are, each in its turn, deposited between the rollers 5 and 7. As the rollers 5 and 7 are rotated, they advance the balls 15 to an exit plate 19 while rotating the balls. At the exit plate the balls pass through another guide 21. From this guide 21, the balls are returned to the conveyor 17 and again deposited between the rollers 5 and 7. Adjacent the rollers 5 and 7, the emitter 23 of a radiation generator 25 is provided. The radiation may be highly accelerated electrons or protons or x-rays or gamma rays or alpha rays or other heavy particle bombardment. The radiation can also be neutrons generated by a neutron source in the generator 25. The radiation emitter 23 directs the radiation onto the balls rotating and advancing along the rollers 5 and 7. The tennis balls 15 are thus appropriately irradiated.

The balls 15 are circulated repeatedly across the rollers 5 and 7 and thus receive the desired radiation. The rotation of the balls 15 by the rollers 5 and 7 assures that the balls are uniformly irradiated. The uniformity is enhanced by the repeated conveyance of the balls through the guide 11. During different cycles, the balls 15 are deposited at different orientations on the rollers 5 and 7.

Alternatively, the rollers 5 and 7 may be elongated rollers with a plurality radiation generators 25 disposed with their emitters 23 spaced along the rollers and a collector for treated balls at the remote end of the rollers.

A number of tennis balls (both pressurized and unpressurized) were irradiated with $10^7$ rads in accordance with this invention and the dynamic resiliency of these irradiated balls were determined. The precise compositions of these balls are unknown since this information is considered proprietary; however, the irradiated balls are believed to consist primarily of natural rubber with some significant fraction of one or more synthetic rubbers. The results of the irradiation on the tennis balls are shown in the following Table 1:

Table 1

Effect of Irradiation on Dynamic Resiliency of Tennis Balls

| Sample | Increase in Dynamic Resiliency |
|---|---|
| A (new ball - pressurized) | +12% |
| B (new ball - pressurized) | 17% |
| C (new ball - pressurized) | 21% |
| D (new ball - unpressurized) | 14% |
| E (new ball - pressurized) | 2% |
| F (used ball - low pressure inside) | 18% |
| G (used ball - low pressure inside) | 29% |
| H (used ball - low pressure inside) | 24% |
| I (used ball - low pressure inside) | 8% |
| J (used ball - low pressure inside) | 21% |
| K (used ball - low pressure inside) | 24% |

Table 1-continued

Effect of Irradiation on Dynamic Resiliency of Tennis Balls

| Sample | Increase in Dynamic Resiliency |
|---|---|
| L (used ball - low pressure inside) | 26% |
| M (used ball - low pressure inside) | 17% |

In all cases an improvement in dynamic resiliency was noted. No significant change in other important properties other than increase in the abrasive resistance was noted.

The data in Table 1 shows that the dynamic resiliency of tennis balls is improved by irradiation so that the irradiated tennis balls are more lively than unirradiated balls.

With irradiation it is feasible to obtain tennis balls having the desired lively characteristics using less expensive materials, i.e., a higher percentage of less expensive elastomeric materials. Also, it is possible to obtain by means of irradiation an unpressurized tennis ball which has the desired lively properties of pressurized tennis balls.

The following are among the advantages which arise from irradiation of tennis balls in accordance with this invention:

1. The thickness of the walls of inner core may be reduced.
2. The liveliness of unpressurized balls can be improved to the point where they are equivalent to unirradiated pressurized balls.
3. The proportion of less costly synthetic rubber in the core may be increased.
4. The internal pressure in pressurized balls is maintained for a longer interval than for unirradiated balls.

While certain embodiments of this invention have been disclosed herein, many modifications thereof are feasible. This invention is not to be restricted except insofar as is necessitated by the spirit of the prior art.

I claim:

1. The method of improving the dynamic resilience of a tennis ball comprising the steps of a. forming the inner core of a tennis ball of an elastomeric rubber, b. irradiating said core with from $10^5$ to $10^{10}$ rads of radiation so as to promote predominant cross linking of the molecules of the rubber and to increase its dynamic resilience, and c. securing a cover to said core.

2. The method of claim 1 wherein the ball is uniformly irradiated.

3. The method of claim 1 wherein the ball is rotated while it is being irradiated so that the radiation is uniform.

4. The method of improving the dynamic resilience according to claim 1 of an unpressurized tennis ball.

* * * * *